US008881970B2

(12) United States Patent
Campanini

(10) Patent No.: US 8,881,970 B2
(45) Date of Patent: Nov. 11, 2014

(54) TICKET PRINTER

(75) Inventor: Alberto Campanini, Fidenza (IT)

(73) Assignee: Custom S.p.A. (IT)

( * ) Notice: Subject to any disclaimer, the term of this patent is extended or adjusted under 35 U.S.C. 154(b) by 0 days.

(21) Appl. No.: 13/982,281

(22) PCT Filed: Feb. 16, 2012

(86) PCT No.: PCT/IB2012/050719

§ 371 (c)(1),
(2), (4) Date: Oct. 22, 2013

(87) PCT Pub. No.: WO2012/110981

PCT Pub. Date: Aug. 23, 2012

(65) Prior Publication Data

US 2014/0034718 A1 Feb. 6, 2014

(30) Foreign Application Priority Data

Feb. 17, 2011 (IT) ..... MO2011A0033

(51) Int. Cl.

| | |
|---|---|
| ***G07G 1/00*** | (2006.01) |
| ***G07F 19/00*** | (2006.01) |
| ***G07F 17/42*** | (2006.01) |
| ***G07B 1/06*** | (2006.01) |
| ***B41J 3/30*** | (2006.01) |
| ***B41J 15/00*** | (2006.01) |
| ***B41J 11/70*** | (2006.01) |

(52) U.S. Cl.

CPC . *B41J 3/30* (2013.01); *G07F 17/42* (2013.01); *G07B 1/06* (2013.01); *B41J 15/005* (2013.01); *B41J 11/70* (2013.01)

USPC ..... 235/3; 235/379

(58) Field of Classification Search

USPC ..... 235/3, 17, 18, 379

See application file for complete search history.

(56) References Cited

U.S. PATENT DOCUMENTS

| | | | | | |
|---|---|---|---|---|---|
| 4,374,564 | A * | 2/1983 | Miller et al. | 209/583 |
| 4,493,103 | A * | 1/1985 | Yamashita et al. | 382/104 |
| 4,535,892 | A * | 8/1985 | Roes et al. | 209/3.3 |
| 4,992,647 | A * | 2/1991 | Konishi et al. | 235/379 |
| 5,076,556 | A * | 12/1991 | Mandel | 270/45 |
| 5,268,561 | A * | 12/1993 | Kimura et al. | 235/384 |
| 5,646,668 | A * | 7/1997 | Fujioka et al. | 347/104 |
| 6,428,226 | B1 | 8/2002 | Suzuki et al. | |
| 6,565,274 | B1 * | 5/2003 | Lyons | 400/619 |
| 6,639,688 | B2 * | 10/2003 | Imai | 358/1.14 |
| 7,395,744 | B2 * | 7/2008 | Connor | 83/106 |
| 2005/0286955 | A1 | 12/2005 | Weeks et al. | |
| 2006/0072953 | A1 | 4/2006 | Vienneau et al. | |
| 2011/0017795 | A1 | 1/2011 | Lin | |

* cited by examiner

*Primary Examiner* — Tuyen K Vo

(74) *Attorney, Agent, or Firm* — Laubscher & Laubscher, P.C.

(57) ABSTRACT

A ticket printer includes a path along which a strip of paper advances. The path terminates at a presentation outlet of a ticket separated from the strip. On the path, there is a movable deviating body that can selectively close or open an accumulating zone that branches off from the path and can receive a part of a strip that will be severed to form the ticket.

13 Claims, 6 Drawing Sheets

TICKET PRINTER

This application is a §371 National Stage of PCT International Application No. PCT/IB2012/050719 filed Feb. 16, 2012. PCT/IB2012/050719 claims priority to IT Application No. MO2011A000033 filed Feb. 17, 2011. The entire contents of these applications are incorporated herein by reference.

BACKGROUND OF THE INVENTION

The invention relates to a ticket printer, in particular for printing on a paper or cardboard printing support or a support made of a material that is similar to paper or cardboard.

In particular, reference is made to a printer provided with a device for severing printed tickets from a strip of a printing support, and in which the printed ticket can be presented to a user through an outlet slit or can be stored in a collecting zone inside the printer.

Specifically, but not exclusively, the invention can be used for printing receipts for transactions, lottery tickets, car park tickets, etc.

The prior art comprises various types of ticket printer provided with a system for presenting the ticket, such as, for example, the printer shown in the patent publication US 2006/0072953.

SUMMARY OF THE INVENTION

One object of the invention is to make a printer that is able to present a printed ticket at a presentation outlet effectively and reliably.

One advantage is providing a printer that is able to send the printed ticket selectively to the presentation outlet or to an internal collecting zone.

One advantage is ensuring the efficacy of the grasp of the printing support by the driving device, which has to send the support to the presentation outlet and/or to the collecting zone.

One advantage is ensuring the preset movement of the printing support even in the event of complex movement paths, such as, for example, if the support, shaped as a strip, has to form a loop in a temporary accumulating zone.

One advantage is making available a printer that is constructionally simple and cheap.

One advantage is giving rise to a printer of relatively compact dimensions.

One advantage is reducing the risk of an incorrect movement (for example jamming) of the printing support (made of paper or similar material).

One advantage is presenting the ticket at the presentation outlet in such a manner as to promote easy grasping of the ticket by the user.

One advantage is presenting the ticket at the outlet in such a manner that a considerable part of the ticket has exited and is thus graspable by the user.

One advantage is making a printer available in which it is possible to insert, or reinsert, a preprinted ticket or ticket previously printed by the printer, and process it according to preset control sequences, for example by carrying out identification of the ticket and consequently issuing a signal, in particular a signal that is usable by actuating devices outside the printer.

Such objects and advantages, and still others, are achieved by the printer according to one or more of the claims set out below.

In one embodiment, a printer comprises a path along which a strip (printing support) advances; the path has at least one end at a presentation outlet of a ticket separated from the strip; on the path there is at least one movable body that can selectively close or open an accumulation zone that branches off from the path and which can receive the strip before the ticket is separated.

BRIEF DESCRIPTION OF THE DRAWINGS

The invention can be better understood and implemented with reference to the attached drawings that illustrate an embodiment thereof by way of non-limiting example.

DETAILED DESCRIPTION

Figure 1:
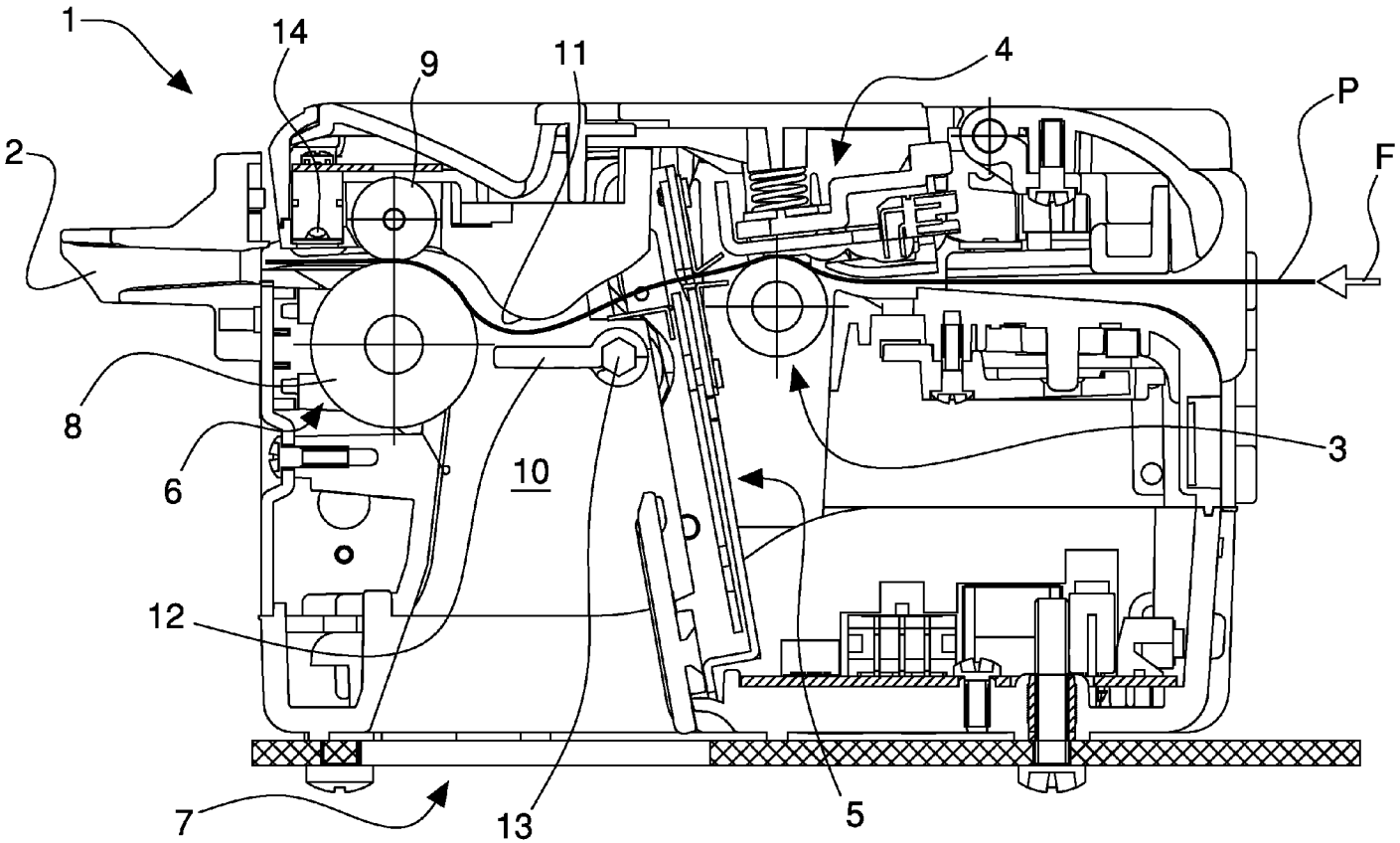
FIGS. 1 to 4 show diagrams in a vertical elevation of a printer according to the invention, in four different operating steps in a first operating mode.
Figure 2:
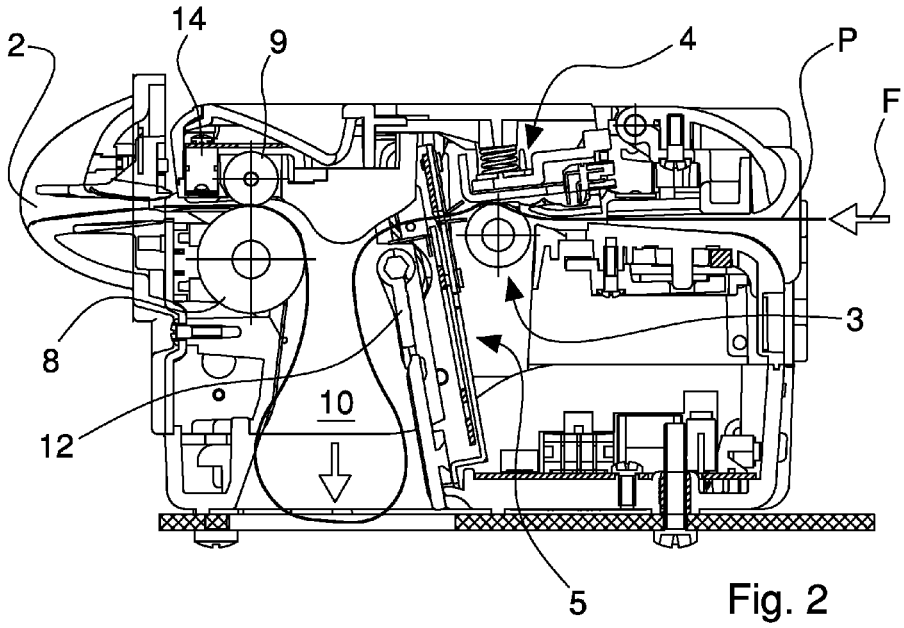

With reference to the aforesaid figures, with 1 a printer, in particular a ticket printer, has been indicated comprehensively.

The printer 1 comprises an advancing path along which a strip P of a printing support (for example a strip of paper or cardboard or other paper or similar material) is supplied in an advancing direction F. The strip P can be, in particular, a continuous printing support intended for being cut or detached transversely to form the printed tickets. The strip S can be supplied, as in this case, by a reel (not shown), or by a ticket magazine of the fan fold type (continuous tickets folded into a packet) or by other supplying systems. The strip S supplying system can be of known type. The strip S supplying system can be outside the printer.

A ticket is here defined as an element of any size, stiff or flexible, for example made of paper or cardboard, for forming receipts for transactions, car park tickets, lottery tickets, etc.

The printer 1 comprises a presentation outlet 2 through which an operator can receive the printed ticket T. This outlet 2 can comprise a slit located on an external side of the printer.

The printer 1 may comprise a first driving device 3 to supply the strip S along the advancing path. The printer 1 may comprise a printing device 4 for printing on the strip that advances along the path. The first driving device 3 and the printing device 4 can be part, as in the specific example, of a single printing head. The printing device 4 may comprise, for example, a thermal printer. The first driving device 3 and the printing device 4 may, as in the specific example, cooperate together to print, in particular they can be arranged facing one another on opposite sides of the path of the strip P. The first driving device 3 may comprise a driving roller (for example a rubber-coated roller) that guides the strip P along the advancing path to the outlet 2.

The printer 1 may comprise a severing device 5 for separating a ticket T from the strip P. The severing device 5 may comprise a cutting device, for example of the guillotine type (blade or cutter). The severing device 5 may be arranged after the first driving device 3 and/or after the printing device 4, where "after" is defined with reference to the advancing direction F of the strip along the path to the outlet 2.

The printer 1 may comprise a second driving device 6 for receiving the strip P from the first driving device 3. The second driving device 6 is arranged after the first driving device 3 and/or after the severing device 5.

The second driving device 6 is reversible, i.e. is able to supply an object (the strip P or the ticket T) in both directions. In particular, the second driving device 6 is configured to supply the object (the ticket) selectively in a first direction to the outlet 2, and in a second direction, opposite the first, to a ticket collecting zone 7 in communication with the path. The ticket collecting zone 7 may comprise include an accumulating or storing arrangement (container or chamber or tank) inside the printer. The ticket accumulating or storing arrangement, which can be of known type, is not illustrated. The collecting zone 7 may be arranged in a lower zone of the printer for receiving the tickets that fall once they disengage from the first or from the second driving device 3 or 6.

The second driving device 6 may comprise, as in the specific example, a pair of driving rollers (for example a rubber-coated roller 8 and counter-roller 9). The driving rollers 8 and 9 may be arranged on top of one another, with reference to a use configuration of the printer (see FIGS. 1 to 10). The pair of rollers 8 and 9 defines a contact zone of the strip or ticket. The rollers 8 and 9 are conformed and arranged in such a manner that the strip or ticket is engaged in the contact zone according to a horizontal direction (tangential to the rollers). This contact zone may face (for example at the same vertical level) the presentation outlet 2 of the ticket T.

The printer 1 comprises an accumulating zone 10 (temporary accumulation) in which an object (ticket), which has been received by the first or by the second driving device 3 or 6, can be housed (temporarily) to then be supplied selectively to the outlet 2 or to the collecting zone 7. The accumulating zone 10 may be a zone that branches off from the path or extends downwards from an intermediate zone of the path. The accumulating zone 10 is interposed between the path and the collecting zone 7. The accumulating zone 10 is arranged below (with reference to the configuration of use of the printer) the aforesaid intermediate zone of the path. The intermediate zone of the path, from which the accumulating zone 10 branches off, is arranged between the first and the second driving device 3 and 6.

The path is conformed in this intermediate zone in such a manner as to have a trajectory of the strip of convex curved shape with the convexity facing the accumulating zone 10. Substantially, the path is conformed in such a manner as to induce the strip P, which is provided with flexibility, to form a fold facing the accumulating zone 10. This convex curved shape may be supplied by a shaped guiding element 11 arranged in the intermediate zone of the path, in particular on the upper side of the path. This convex curved shape may be arranged, partially or entirely, at a lower vertical level than the contact zone of the rollers 8 and 9.

The printer 1 comprises a movable body 12 configured for adopting a first position (FIG. 1) in which it is arranged on the path of the strip P to close the accumulating zone 10, such as to prevent the strip P entering, and a second position (FIG. 2) in which the accumulating zone 10 opens to enable the strip P to enter. The movable body 12 may operate, substantially, as a deviating element to direct the strip P in the desired direction. The movable body 12 may comprise, as in the specific case, a gate or door that is movable to be opened or closed. In the first closing position the deviating movable body 12 places itself between the path (in particular the intermediate zone thereof) and the accumulating zone 10.

The movable body 12 is driven at the command of an actuating device configured for taking the movable body 12 from the first position to the second position and vice versa. Such an actuating device may include, as in the specific example, an electric motor (not shown) or other type of drive (magnetic, pneumatic, etc). The movable body 12 moves actively at the command of a motor. The movable body 12 acts as a deviator, as it is able to adopt at least one position (the first closing position) in which it acts as a barrier to the strip in order to prevent the strip accessing a pathway and to force the strip to follow another pathway.

The guiding element 11 may face the movable body 12 arranged in the first closing position. The movable body 12 may have a wall (gate or barrier) that, in the first closing position, is arranged, at least partially or entirely, at a lower vertical level than the contact zone where the rollers 8 and 9 engage the strip or the ticket. The movable body 12 may be arranged, in the first closing position, above the accumulating zone 10 of the strip (with reference to a use configuration of the printer). The movable body 12 may be arranged, in the second opening position, next to the accumulating zone 10.

The movable body 12 may comprise, as in this example, a gate with at least one part (wing) rotatable around a rotation pivot 13 between the first position and the second position. In other examples that are not illustrated, the movable body 12 may comprise a gate with two rotating wings or with one or two sliding wings, or a gate with wing/s of the bellows type, or one or more sliding gates or barriers, or one or more rolling-gate elements, or still other types of movable closing elements.

The printer 1 comprises a sensor 14 that is operationally associated with the strip or ticket. The sensor 14 is able, in particular, to provide a signal indicating at least the fact that the strip P has reached a determined position in which it has been received by the second driving device 6. This sensor 14 may comprise, in particular, a presence sensor for detecting the presence of the strip or of the ticket. This sensor 14 may comprise, for example, a sensor included in the group comprising: an optical sensor, a presence sensor, an information reader (for example a barcode reader), a proximity sensor. This sensor 14 may be arranged, as in this example, after the second driving device 6, in particular immediately after this device 6 and just before the outlet 2.

The printer could comprise, in embodiments that are not illustrated here, a further sensor configured for sending a signal indicating the fact that the strip has reached a position that is suitable for separating the ticket T, i.e. a position on the path in which the strip portion intended for forming the end edge of the ticket T to be separated is arranged at the severing device. This further sensor may comprise, for example, a reader that is able to recognise a reference arranged on the strip in a preset position.

The printer 1 further includes a control unit configured for controlling the actuating device driving the movable body 12. The control unit may be configured for controlling the various actuators of the printer and for receiving signals from the various sensors of the printer. In particular, the control unit may be configured for controlling the operating steps of one or more operating modes of the printer. For this purpose, the control unit could be associated with a software programme containing the instructions for running the operating steps of the various desired operating modes.

Figure 3:
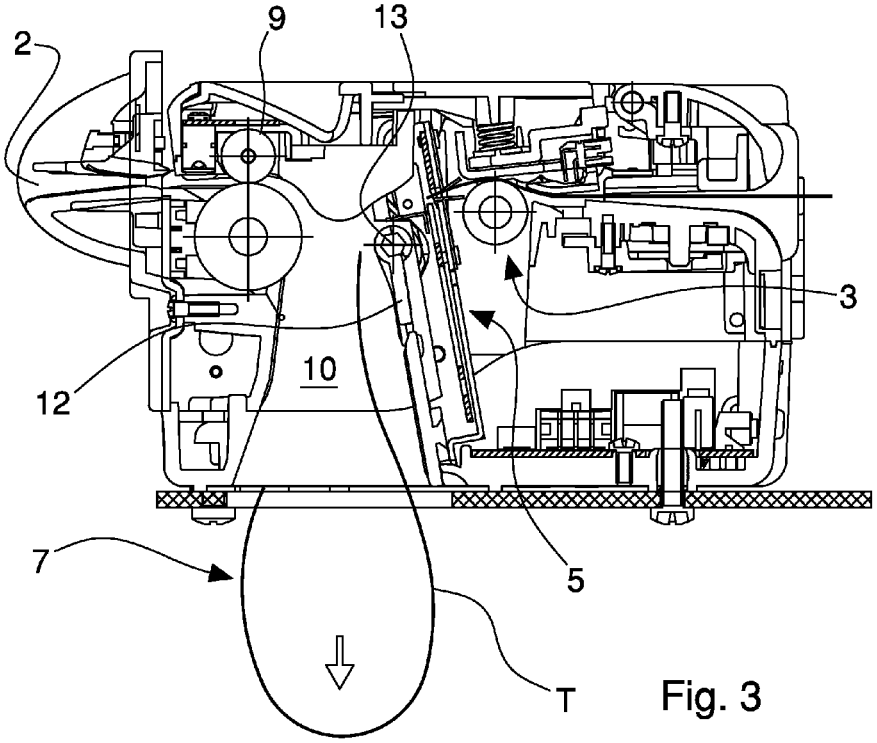
Figure 4:
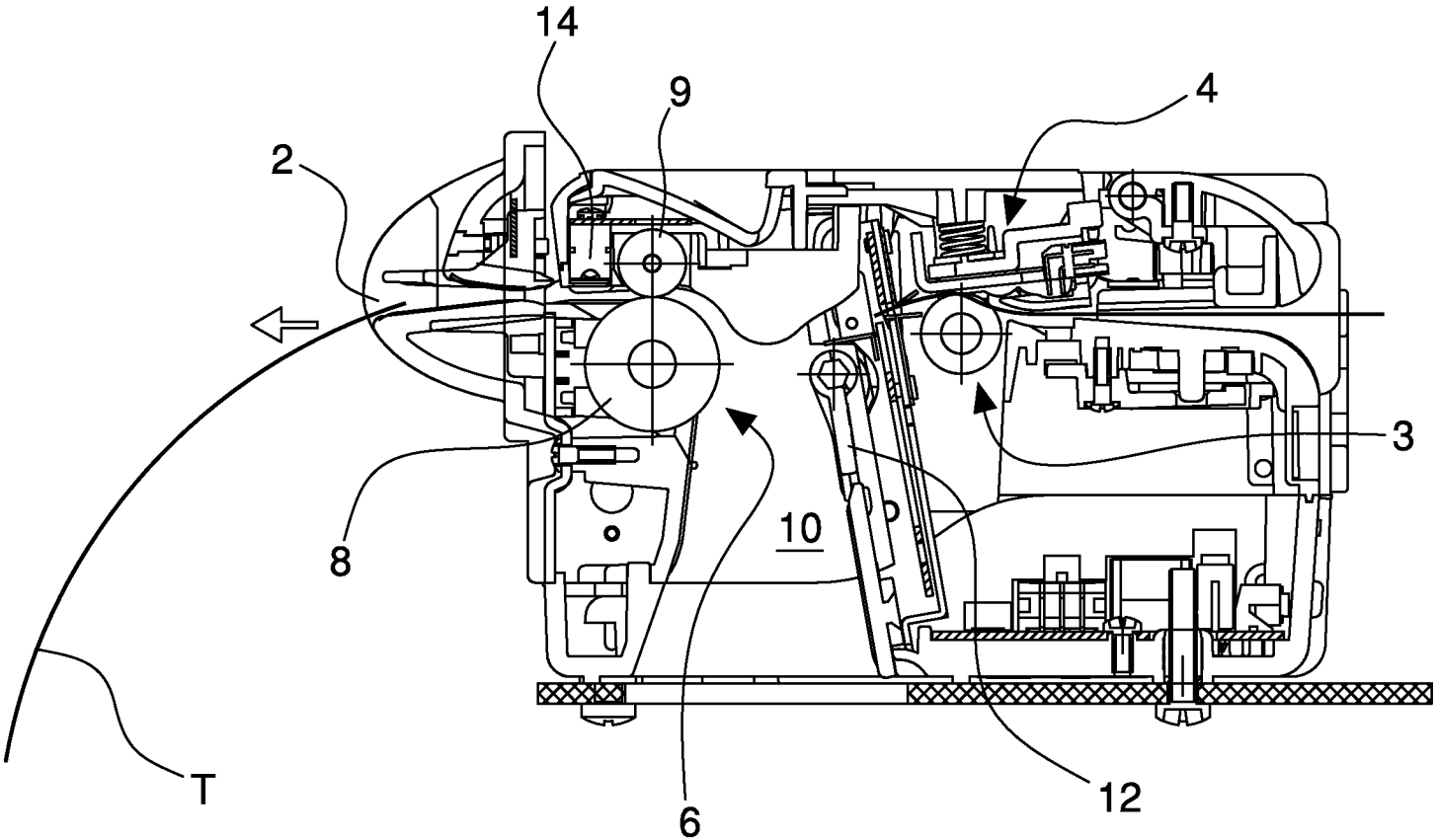

In FIGS. 1 to 4, a first operating mode is disclosed. The operating steps of this first operating mode comprise, in particular: (i) a first driving step of the first driving device 3 to supply the strip along the path to the second driving device 6 (FIG. 1); in this first step, the movable body 12 will be arranged in the first closing position and the second driving device 6 will be driven at least for receiving the strip in such a manner as to engage the latter; in this first step the strip can be printed; this first step terminates with the arrest of the second driving device 6, when the strip has been received and is engaged by the second driving device 6, i.e. at the reception of a signal supplied by the sensor 14 (see FIG. 1); (ii) a second step (FIG. 2) in which the first driving device 3 continues to be driven, with the movable body 12 moved into the second opening position and with the second driving device 6 stationary, such that a front strip part is immobilised by the second driving device 6 (between the two rollers 8 and 9) whilst the advancing of the rest of the strip causes an accumulation of strips in the accumulating zone 10; this accumulation can comprise, in particular, the formation of a strip loop in the accumulating zone (see FIG. 2); (iii) a third step in which the severing device 5 forms the ticket T by severing the ticket T from the strip P; activating the severing device 5 can be controlled, for example, on the basis of the signal supplied by the further sensor; (iv) a fourth step (FIG. 3 or 4) in which the second driving device 6 is driven selectively either in the first direction (advancing), in order to direct the ticket T to the presentation outlet 2 to the user (FIG. 4), or in the second direction (retracting), to direct the ticket T to the collecting zone 7 (FIG. 3).

In general, owing to the movable body 12 arranged in the first closing position, the strip can advance along the path with the certainty of being directed to the second driving device 6 to be engaged by the second driving device 6. In particular, the strip will reach the contact zone between the driving rollers. By moving the movable body to the second opening position, it will be possible to insert the strip into the accumulating zone. It should be noted that, by virtue of the preformed fold on the strip in the intermediate zone of the path made by the curved conformation of the path, subsequent spontaneous formation of an accumulation of the strip in the shape of a loop that widens inside the accumulating zone (below), as the rear part of the strip advances is significantly facilitated, whilst the front part remains stationary engaged in the driving rollers.

Figure 5:
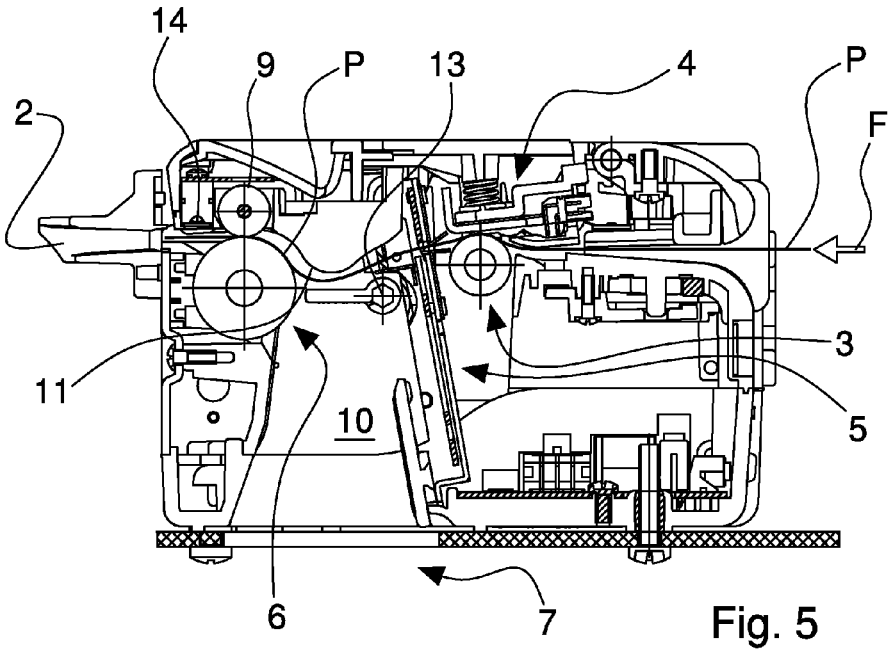
FIGS. 5 to 10 show diagrams, in a vertical elevation, of the printer in FIG. 1 in six different operating steps relating to other operating modes.
Figure 6:
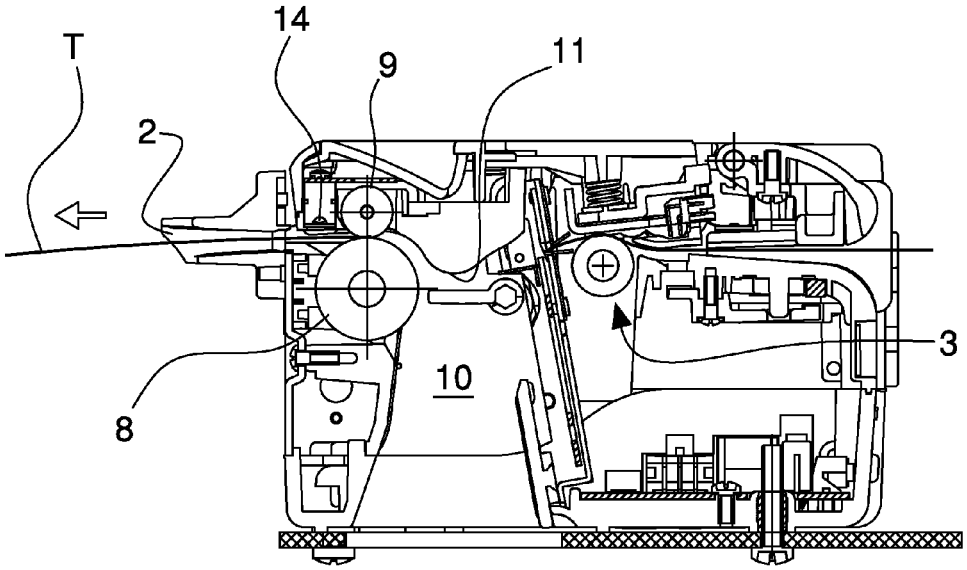

In a second operating mode, the strip P of the printing support is supplied to the presentation outlet 2 (FIG. 5). Simultaneously, the strip zone is printed that will form the ticket T. In this first step, the movable body 12 is in the closed position. In a second step (FIG. 6), after the ticket T is cut, it is taken to the outlet 2 to be presented to the user. Also in this second step the movable body 12 is in the closing position. This operating mode enables very long tickets to be printed (up to several meters of printed paper).

Figure 7:
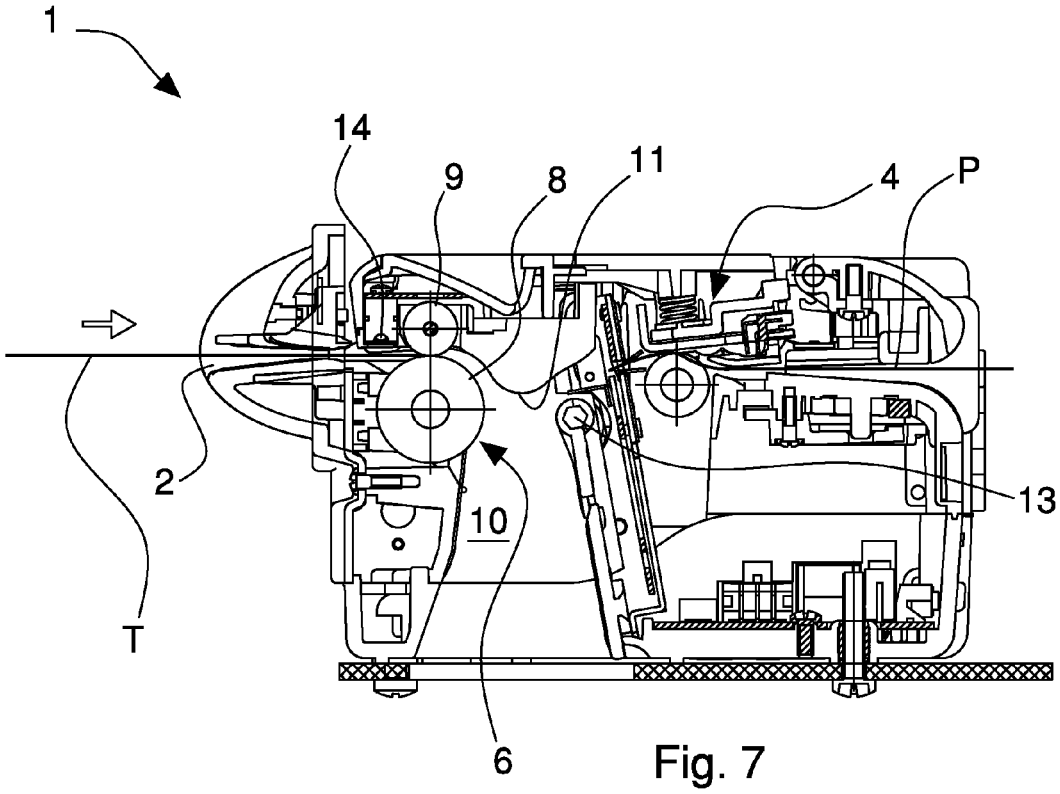
Figure 8:
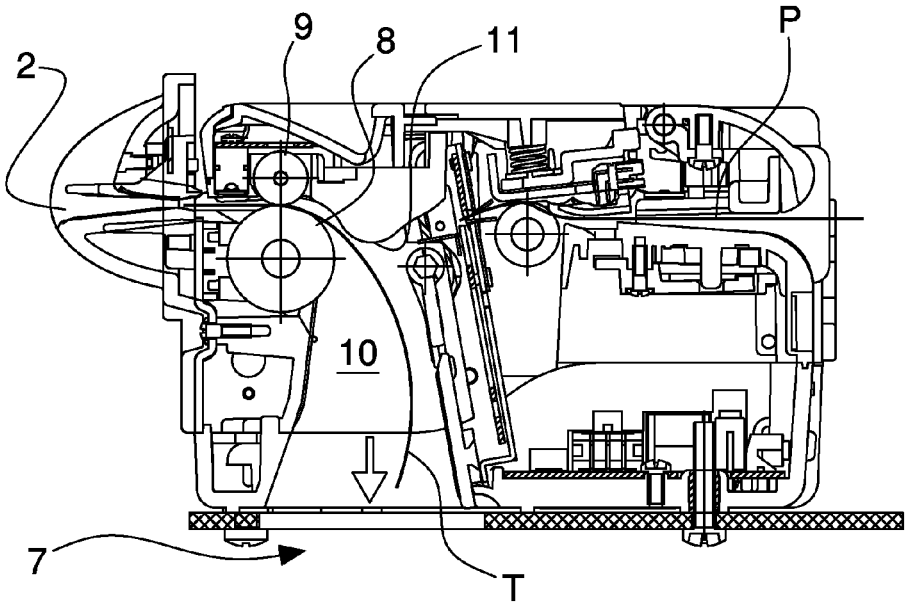

In a third operating mode, a ticket can be reinserted inside the printer, for example through the presentation outlet 2, which in this case can act as the ticket inlet (FIG. 7). This step can, for example, be useful for returning the ticket after the user has carried out an operation, for example a transaction, relating to the ticket. The reinserted ticket could be a ticket printed previously by the printer. One specific use could be in particular to return the ticket of a car park following payment. Subsequently (FIG. 8), the second driving device 6 will insert the ticket inside the printer, for example to store the ticket in the collecting zone 7. The movable body 12 can be positioned in opening to enable the ticket to access the collecting zone 7. In this step, information on the ticket can be read (for example a barcode can be read) by a sensor located at the inlet mouth of the ticket (for example the sensor 14 located at the outlet 2). This information may refer to the identification of the ticket. The control unit of the printer can be connected to a central management system that is able to recognise the ticket and perform an operation in function of this recognition (for example it permits the exit from the car park). In this ticket reinserting step, in which the information on the ticket can be read and/or the ticket can be stored in the collecting zone 7, the presence of the guiding element 11 enables the ticket to be sent correctly to the accumulating zone 10. The guiding element 11 could also facilitate expulsion of the ticket (after reading on the information on the ticket) to the outlet 2.

Figure 9:
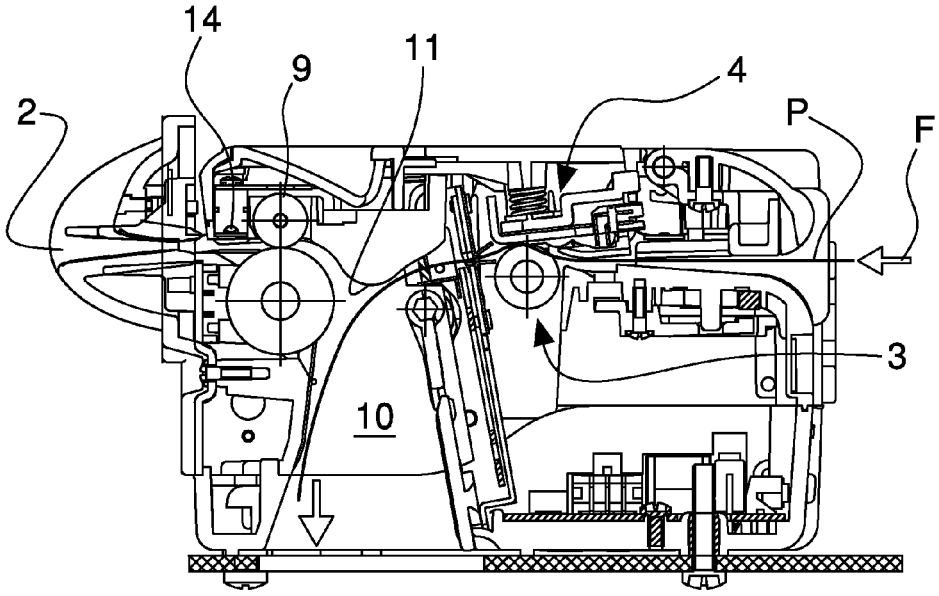
Figure 10:
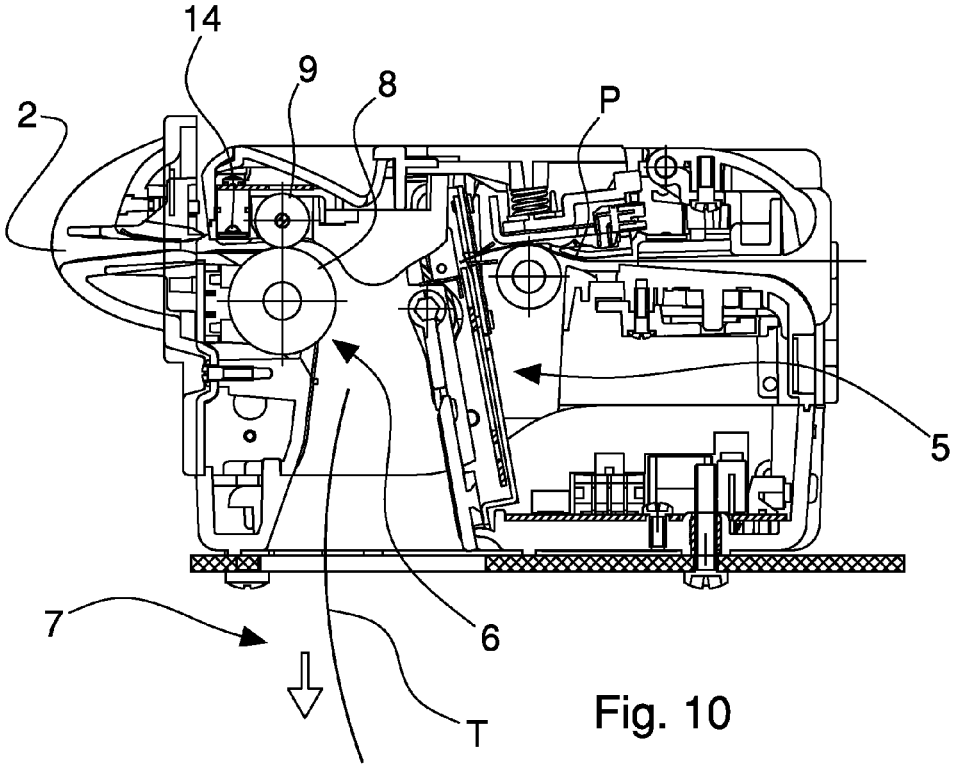

It is possible to provide a fourth operating mode, illustrated in FIGS. 9 and 10, in which the strip P is directed to the accumulating zone 10 without moving from the second driving device 6. In this fourth operating mode, the strip P is supplied by the first driving device 3 with the movable body 12 in the second opening position (FIG. 9). In this step, during advancing of the strip, the ticket will be printed. The strip will thus be directed to the accumulating zone, encouraged by the presence of the guiding element 11 that supplies the curved conformation of the intermediate zone of the path. In this case, once the severing device 5 has formed the ticket T by separating the ticket T from the rest of the strip, the ticket can fall freely into the collecting zone (FIG. 10). This operating mode can be used for storing tickets on which the electronic journal of a cash register, or mother-daughter copies of tickets or receipts are printed, or a periodical report is printed (for example on the activities of the printer).

The invention claimed is:

1. A printer, comprising (a) a path wherein a strip of a printing support advances towards an outlet of a printed ticket obtained from the strip;

(b) a first driving device for supplying the strip along said path;

(c) a printing device for printing on the strip arranged on said path;

(d) a severing device for severing a ticket from the strip;

(e) a second driving device for receiving the strip from said first driving device;

(f) a collecting zone in communication with said path for receiving a ticket;

(g) an accumulating zone wherein the ticket or the strip can be housed, said accumulating zone being arranged between said path and said collecting zone; and (h) at least one movable body configured to assume a first position wherein it closes said accumulating zone to prevent the strip from entering the accumulating zone from said path, and a second position wherein said accumulating zone opens to enable the strip to enter the accumulating zone, said movable body in said second position leaving said path toward both said first driving device and said second driving device open.

2. A printer according to claim 1, wherein said second driving device is reversible to supply the ticket selectively in a first direction towards said outlet, and in a second direction, opposite the first direction, towards said collecting zone.

3. A printer according to claim 2, and further comprising an actuating device configured for displacing the movable body between said first position and said second position, and a control unit configured for controlling said actuating device.

4. A printer according to claim 3, wherein said control unit comprises an arrangement for (1) driving said first driving device for supplying the strip along said path towards said second driving device, with said movable body arranged in the first closing position and said second driving device driven for receiving the strip;

(2) stopping said second driving device upon receipt of a signal, supplied by a sensor, indicating that the strip has reached a given position wherein it has been received from said second driving device;

(3) driving said first driving device, with said movable body moved to the second closing position and said second driving device being stationary, such that a front part of the strip is locked by said second driving device and the advancing of the rest of the strip causes the strip to accumulate in said accumulating zone;

(4) severing a ticket from the strip; and (5) selectively driving said second driving device in the first direction or in the second direction to direct the ticket towards the outlet or towards the collecting zone.

5. A printer according to claim 1, wherein said second driving device operates on said path between said first driving device and said outlet; said accumulating zone extending from an intermediate zone of said path arranged between said first driving device and said second driving device, said severing device operating in said path before said intermediate zone.

6. A printer according to claim 1, wherein said accumulating zone extends from an intermediate zone of said path arranged between said first driving device and said second driving device, said path having in said intermediate zone a curved shape that is convex towards the accumulating zone, such that the strip forms a fold towards the accumulating zone.

7. A printer according to claim 6, wherein said convex curved shape is defined by a shaped guiding element facing said movable body in said first closing position.

8. A printer according to claim 6, wherein said second driving device comprises a pair of rollers arranged on top of one another, with reference to a use configuration of the printer, said pair of rollers defining a contact zone of the strip or ticket, said convex curved shape being arranged at least partially lower than said contact zone.

9. A printer according to claim 1, wherein said second driving device comprises a pair of rollers arranged on top of one another, with reference to a use configuration of the printer, said pair of rollers defining a contact zone of the strip or ticket, said movable body having a wall that, in said first closing position, is arranged at least partially lower than said contact zone.

10. A printer according to claim 1, wherein said movable body in said first closing position is arranged above and said accumulating zone and in said second opening position is arranged next to said accumulating zone, with reference to a use configuration of the printer.

11. A printer according to claim 1, wherein said movable body is rotatable around a rotation pivot between said first position and said second position.

12. A printer, comprising (a) a path wherein a strip of a printing support advances towards an outlet of a printed ticket obtained from the strip;

(b) a first driving device for supplying the strip along said path;

(c) a printing device for printing on the strip arranged on said path;

(d) a severing device for severing a ticket from the strip;

(e) a second driving device for receiving the strip from said first driving device;

(f) a collecting zone in communication with said path for receiving a ticket;

(g) an accumulating zone wherein the ticket or the strip can be housed, said accumulating zone being arranged between said path and said collecting zone; and (h) at least one movable body configured to assume a first position wherein it closes said accumulating zone to prevent the strip from entering the accumulating zone from said path, and a second position wherein said accumulating zone opens to enable the strip to enter the accumulating zone and to enable the strip to accumulate in a loop configuration within said accumulating zone.

13. A printer, comprising (a) a path wherein a strip of a printing support advances towards an outlet of a printed ticket obtained from the strip;

(b) a first driving device for supplying the strip along said path;

(c) a printing device for printing on the strip arranged on said path;

(d) a severing device for severing a ticket from the strip;

(e) a second driving device for receiving the strip from said first driving device;

(f) a collecting zone in communication with said path for receiving a ticket;

(g) an accumulating zone wherein the ticket or the strip can be housed, said accumulating zone being arranged between said path and said collecting zone; and (h) at least one movable body configured to assume a first position wherein it closes said accumulating zone to prevent the strip from entering the accumulating zone from said path, and a second position wherein said accumulating zone opens to enable the strip to enter the accumulating zone, said movable body being arranged above and adjacent to said accumulating zone with reference to a use configuration of the printer when said movable body is in said first and second positions.

* * * * *